US008444497B1

(12) United States Patent
Noye-Boldin et al.

(10) Patent No.: US 8,444,497 B1
(45) Date of Patent: May 21, 2013

(54) OPPOSED JUMPING PLATFORMS APPARATUS

(76) Inventors: Barbara Noye-Boldin, Danya Beach, FL (US); Tirzah Y. Boldin, Danya Beach, FL (US)

( * ) Notice: Subject to any disclaimer, the term of this patent is extended or adjusted under 35 U.S.C. 154(b) by 0 days.

(21) Appl. No.: 12/804,828

(22) Filed: Jul. 29, 2010

(51) Int. Cl.
*A63G 11/00* (2006.01)
*A63G 1/32* (2006.01)

(52) U.S. Cl.
CPC ..... *A63G 11/00* (2013.01)
USPC ..... 472/106; 472/5

(58) Field of Classification Search
CPC ..... A63G 1/32; A63G 11/00; A63G 13/00
USPC ..... 472/4, 5, 106, 108–109, 111–112, 472/135
See application file for complete search history.

(56) References Cited

U.S. PATENT DOCUMENTS

| | | | | | |
|---|---|---|---|---|---|
| 670,706 | A * | 3/1901 | Ernst | 482/24 |
| 1,380,893 | A * | 6/1921 | Gebert | 280/222 |
| 1,898,466 | A * | 2/1933 | Pierson | 472/112 |
| 2,113,488 | A * | 4/1938 | Milton et al. | 472/4 |
| 2,879,995 | A * | 3/1959 | Harrison, III | 472/4 |
| 5,447,474 | A * | 9/1995 | Chang | 472/113 |
| 8,062,142 | B2 * | 11/2011 | Underbrink et al. | 472/113 |

* cited by examiner

*Primary Examiner* — Kien Nguyen
(74) *Attorney, Agent, or Firm* — Frank L. Kubler

(57) ABSTRACT

An opposed jumping platform apparatus includes a fulcrum base; and an opposed platforms member having an opposed platforms member center pivotally mounted on the fulcrum base and dividing the opposed platforms member into a first jumping platform and an opposing second jumping platform, the first jumping platform having a first user support spaced from the opposed platforms member center extending at least one and one half feet above said first jumping platform, and the second jumping platform having a second user support spaced from the opposed platforms member center extending at least one and one half feet above said second jumping platform.

19 Claims, 8 Drawing Sheets

OPPOSED JUMPING PLATFORMS APPARATUS

BACKGROUND OF THE INVENTION

1. Field of the Invention

The present invention relates generally to the field of playground and recreational equipment. More specifically the present invention relates to an opposed jumping platform apparatus including a fulcrum base and an opposed platforms member having a platform member center pivotally mounted on the fulcrum base and dividing the platform member into a first jumping platform and an opposing second jumping platform, the first jumping platform having an upright first user support spaced from the platform member center and the second jumping platform having an upright second user support spaced from the opposed platforms member center. A method of using the opposed jumping platform apparatus is also provided, in which a first user stands upright on the first jumping platform and grips the first user support and a second user stands upright on the second jumping platform and grips the second user support, and then one of the two users jumps and lands on his or her jumping platform, causing his or her jumping platform to pivot downwardly and the opposing jumping platform consequently to pivot upwardly, whereupon the other user jumps and lands on his or her jumping platform, causing his or her jumping platform to pivot downwardly and the opposing jumping platform to pivot upwardly, and these steps are repeated as long as the users wish to continue.

The opposed platforms member preferably is channel-shaped, having a channel connecting wall and longitudinal channel side walls, for added strength to absorb and withstand the impact of user jumping, the channel sides preferably extending upwardly from the connecting wall. The jumping platforms preferably each have a user jumping segment at its respective member free end. The user jumping segments preferably are expanded laterally to provide a broader user standing area.

A foldable version of the apparatus preferably is provided which can be folded into a compact configuration for transport and storage and then redeployed into its unfolded configuration for use when and where desired. For the foldable version, the first jumping platform is separate from and pivotally joined to the second jumping platform by a platform folding pin, and the second jumping platform is narrower than the first jumping platform to pivot on top of and fit within the channel side walls of the first jumping platform.

A four platform embodiment is also provided in which the opposed platforms member is an intersecting platforms structure having two integral intersecting platform members defining first, second, third and fourth jumping platforms, preferably perpendicular to each other defining an intersecting platforms structure center. The intersecting platforms structure connects to a fulcrum base through a universal pivot structure, so that all four jumping platforms can pivot up and down with the opposing jumping platforms pivoting down or up, respectively.

2. Description of the Prior Art

There have long been rides and other recreational devices in playgrounds for entertainment. A problem with many prior recreational devices has been that the operation of the device is largely passive and offers virtually no health benefits or exercise value. Another problem has been that simply sitting and spinning or rocking is not very engaging or exciting, and the use is often limited to two people at a time. Yet another problem has been that prior playground devices usually are large, bulky and anchored to the ground so that storage and transport are difficult or virtually impossible.

It is thus an object of the present invention to provide an opposed jumping platform apparatus on which a user jumps, because jumping vigorously exercises muscles and also causes user feet to hit a hard surface so that calcium goes to strengthening the bones of the feet rather than to the internal organs where it otherwise can form deposits, in some cases leading to the formation of cysts.

It is another object of the present invention to provide such an apparatus having versions which can accommodate more than two people at one time.

It is still another object of the present invention to provide such an apparatus which need not be affixed to the ground and which can be either folded or disassembled for compact transport and storage.

It is finally an object of the present invention to provide such an apparatus which is sturdy, durable, safe and cost competitive to manufacture.

SUMMARY OF THE INVENTION

The present invention accomplishes the above-stated objectives, as well as others, as may be determined by a fair reading and interpretation of the entire specification.

An opposed jumping platform apparatus is provided, including a fulcrum base; and an opposed platforms member having an opposed platforms member center pivotally mounted on the fulcrum base and dividing the opposed platforms member into a first jumping platform and an opposing second jumping platform, the first jumping platform having a first user support spaced from the opposed platforms member center extending at least one and one half feet above said first jumping platform, and the second jumping platform having a second user support spaced from the opposed platforms member center extending at least one and one half feet above said second jumping platform; so that a first user stands on the first jumping platform and grips the first user support and a second user stands on the second jumping platform and grips the second user support, and then the first two user jumps and lands on the first jumping platform, causing the first jumping platform to pivot downwardly and the second jumping platform to pivot upwardly, whereupon the second user jumps and lands on the second jumping platform, causing the second jumping platform to pivot downwardly and the first jumping platform to pivot upwardly, these steps being repeated.

The opposed platforms member preferably is channel-shaped, having a channel connecting wall and channel side walls, for added strength to absorb and withstand the impact of user jumping and to be light in weight. The channel side walls preferably extend upwardly from the channel connecting wall.

The jumping platforms preferably each have a user jumping segment at its member free end. The channel side walls preferably extend from the opposed platforms member center and become shorter at the respective the user jumping segment; so that the user jumping segments have short channel side walls for child users. The channel side walls preferably extend from the opposed platforms member center and terminate at the respective the user jumping segment; so that the user jumping segments have no channel side walls for adult users. The user jumping segments preferably expand laterally to a width greater than the width of the rest of the opposed platforms member to provide a broader user standing area. The user jumping segments preferably expand laterally to a width greater than the width of the rest of the opposed platforms member to provide a broader user standing area. The expanded user jumping segments optionally are substantially circular.

The fulcrum base preferably is a channel-shaped member, including two spaced apart base side walls and a base connecting wall, and extending parallel to and underneath the opposed platforms member. The apparatus preferably additionally includes a base rocking pin passing through wall ports in and extending between the base side walls, the opposed platforms member having downwardly protruding member rocking flanges which are fitted between the base side walls and have rocking flange ports through which the rocking pin passes; so that the rocking pin pivotally mounts the opposed platforms member on the fulcrum base. The first jumping platform optionally is separate from and pivotally joined to the second jumping platform by an platform folding pin; and the second jumping platform optionally is narrower than the first jumping platform to pivot on top of and fit within the channel side walls of the first jumping platform.

The first user support optionally extends at least three feet above the first jumping platform and the second user support extends at least three feet above the second jumping platform. The first user support optionally at least four feet above the first jumping platform and the second user support extends at least four feet above the second jumping platform.

An opposed jumping platform apparatus is further provided, including a fulcrum base; and an intersecting platforms structure having an opposed platforms member center pivotally mounted on the fulcrum base through a rocking mechanism and dividing the intersecting platforms structure into a plurality of jumping platforms, each the jumping platform having a user support spaced from the intersecting platforms structure center and extending at least one and one half feet above said first jumping platform; where the rocking mechanism connects to a fulcrum base through a universal pivot structure, so that all of the jumping platforms can pivot up and down with the opposing the jumping platform pivoting down or up, respectively; so that a user stands on one the jumping platform and grips the corresponding the user support and another user stands on another the jumping platform and grips the corresponding the user support, and then one of the two users jumps and lands on his or her jumping platform, causing his or her jumping platform to pivot downwardly and the opposing the jumping platform to pivot upwardly, whereupon the other user jumps and lands on his or her jumping platform, causing his or her jumping platform to pivot downwardly and the opposing the jumping platform to pivot upwardly.

The fulcrum base optionally is a platform including stacked and interconnected disks having upwardly progressively smaller diameters. The universal pivot mechanism preferably includes a ball secured to and protruding upwardly from the top of the fulcrum base and a socket protruding downwardly from the intersecting platforms structure into which the ball pivotally fits. Each jumping platform preferably includes a user jumping segment which is wider than the width of the rest of the given intersecting platforms structure to provide a broader user standing area. The expanded user jumping segments optionally are substantially circular.

A method of using the apparatus is also provided, including the steps of: a first user standing on the first jumping platform and gripping the first user support; a second user standing on the second jumping platform and gripping the second user support; the first user jumping and landing on the first jumping platform, causing the first jumping platform to pivot downwardly and the opposing second jumping platform to pivot upwardly; and the second user jumping and landing on the second jumping platform, causing the second jumping platform to pivot downwardly and the opposing first jumping platform to pivot upwardly.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
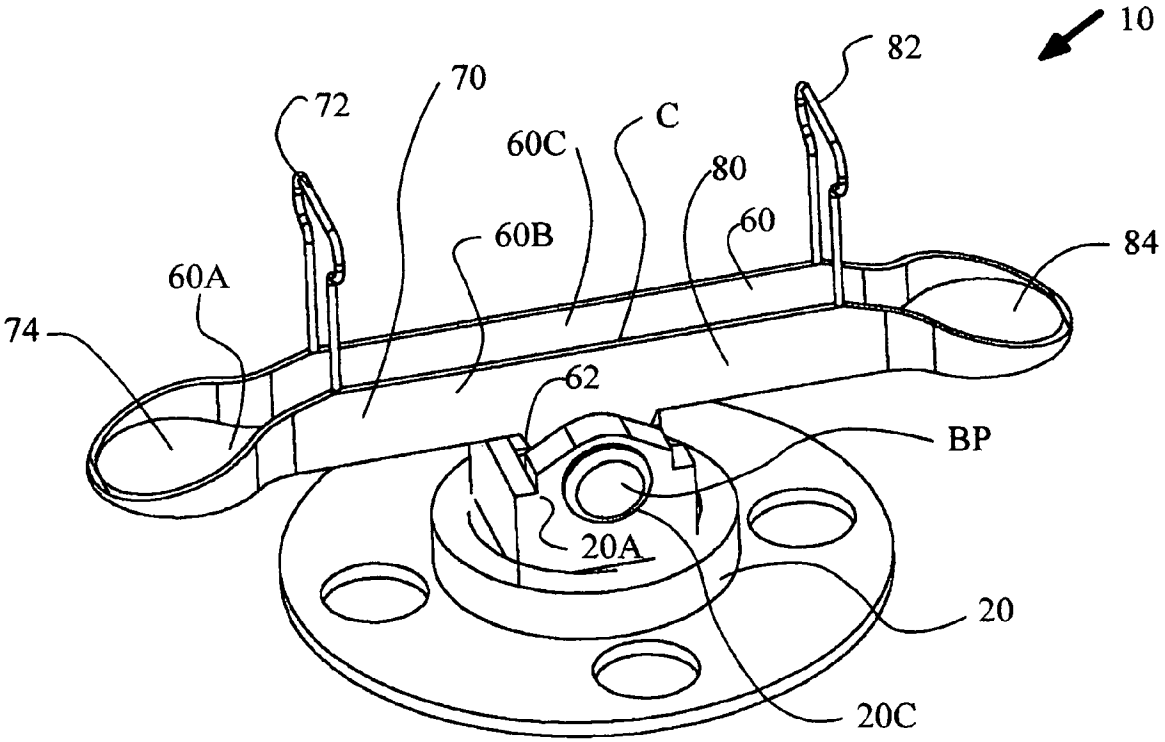
FIG. 1 is a perspective view of the jumping platform apparatus of the first embodiment including an opposed platforms member having two jumping platforms and a fulcrum base including a disk-shaped platform.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
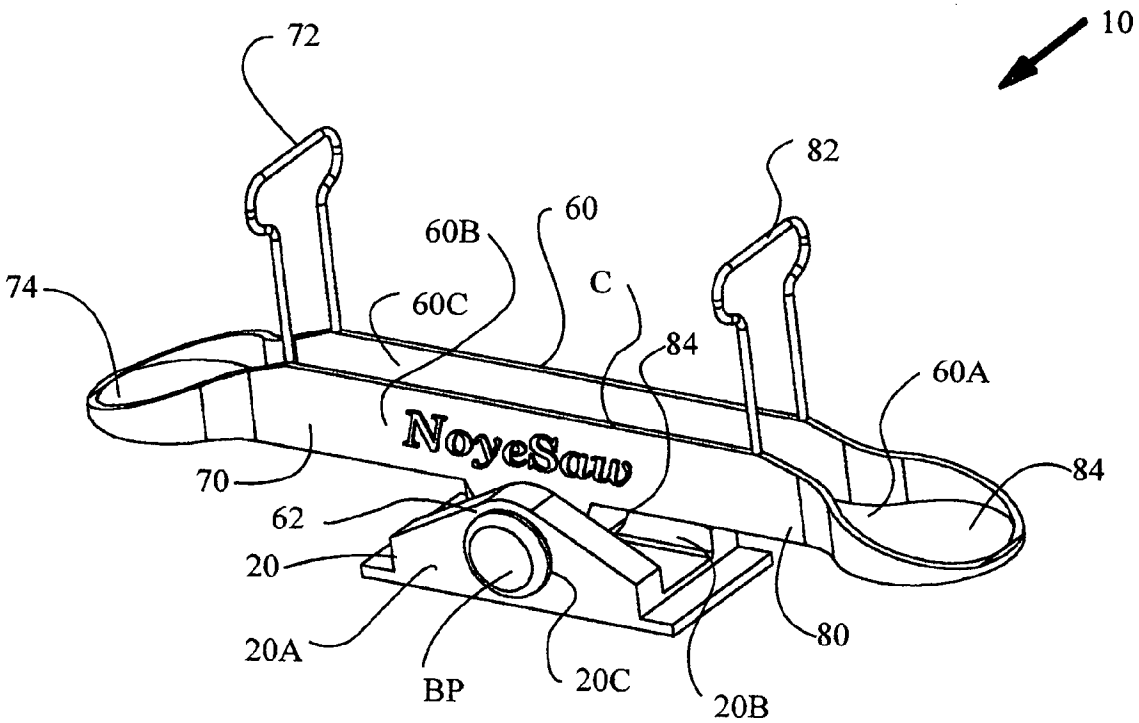
FIG. 2 is a view substantially as in FIG. 1 where the fulcrum base includes a rectangular platform.
Figure 3:
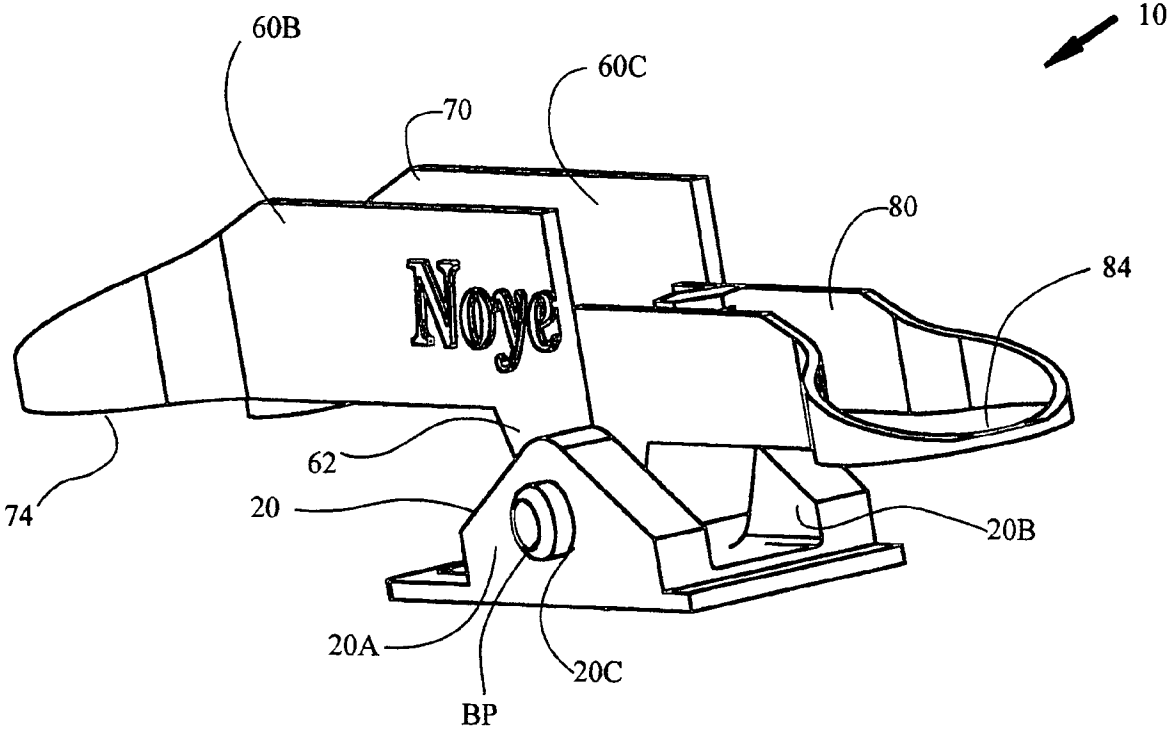
FIG. 3 is a view as in FIG. 1 of the folding version of the first embodiment.
Figure 4:
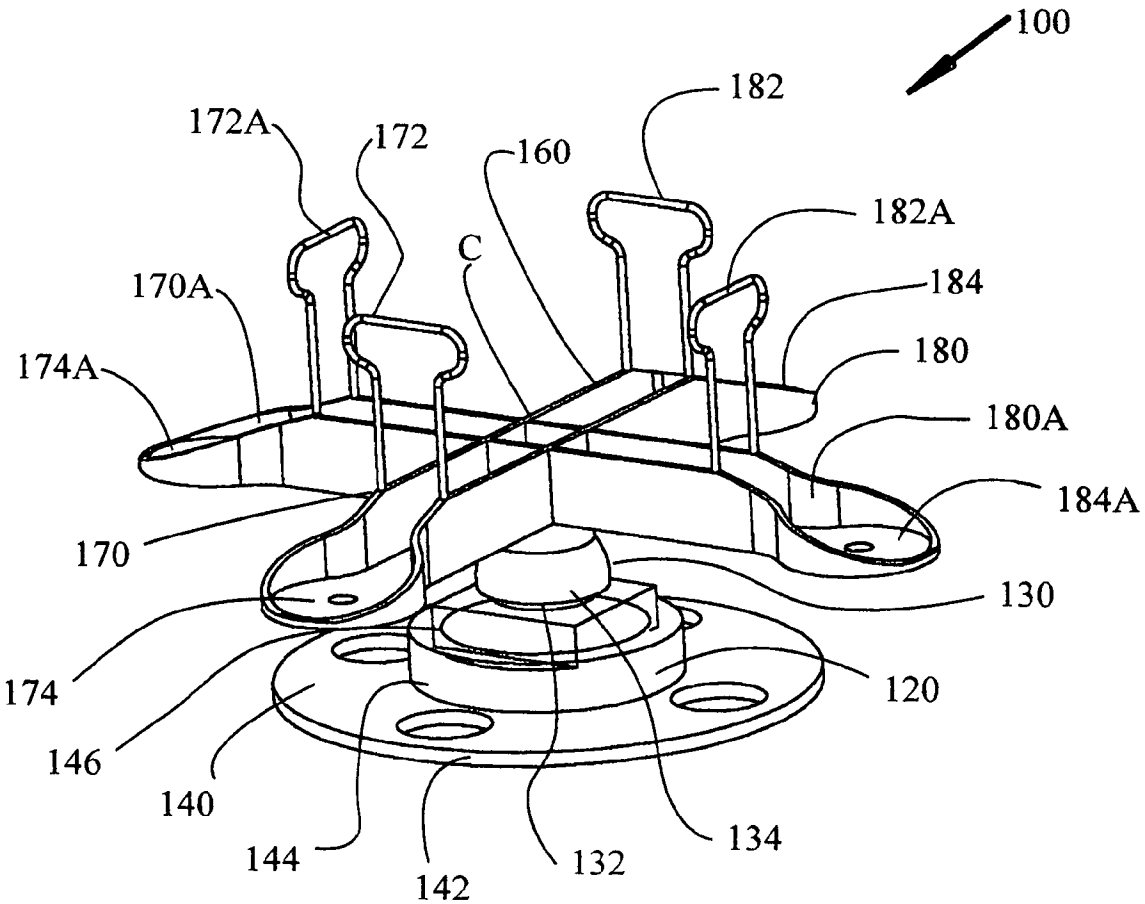
FIG. 4 is a perspective view of the apparatus of the second embodiment including an intersecting platforms structure having four jumping platforms.
Figure 5:
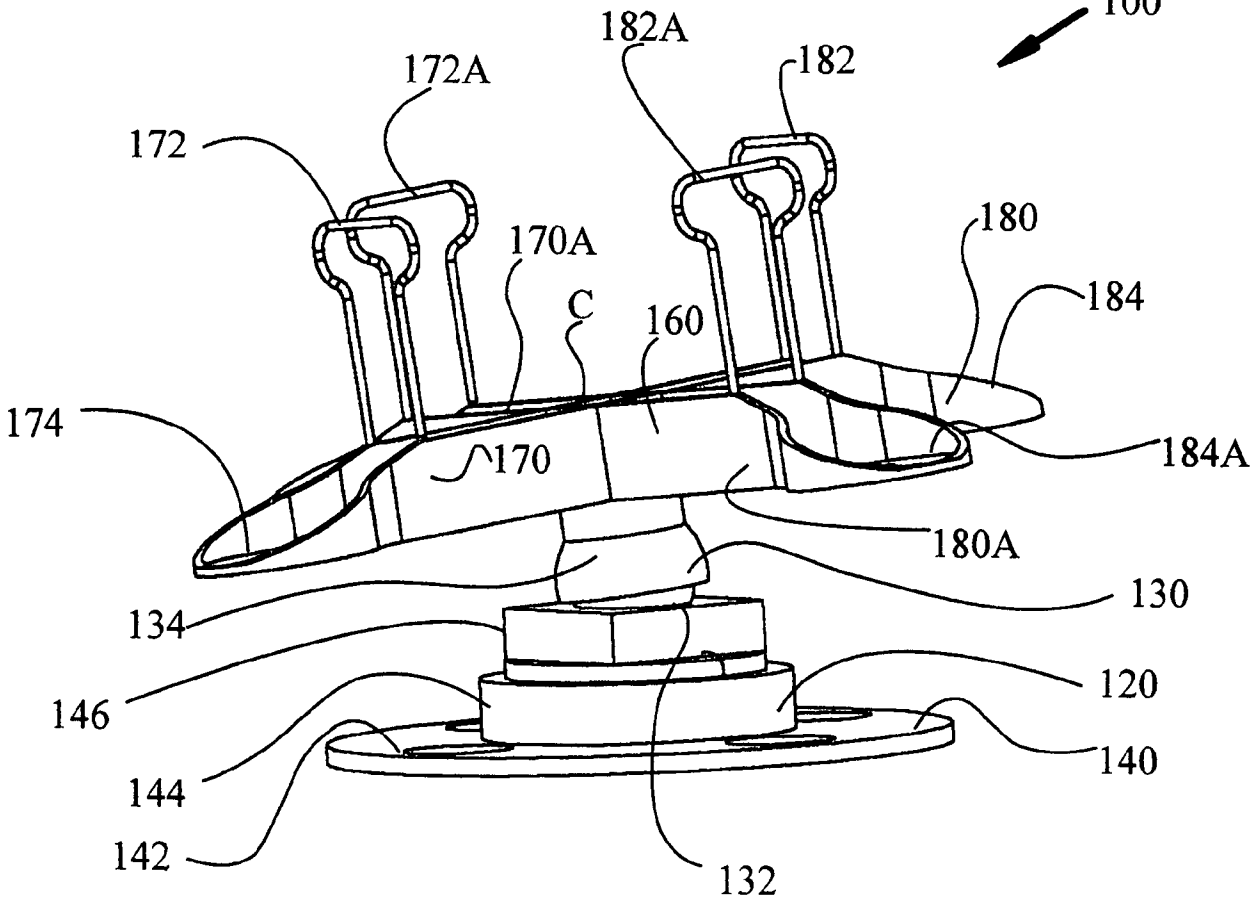
FIG. 5 is a side perspective view of the apparatus of FIG. 4.
Figure 6:
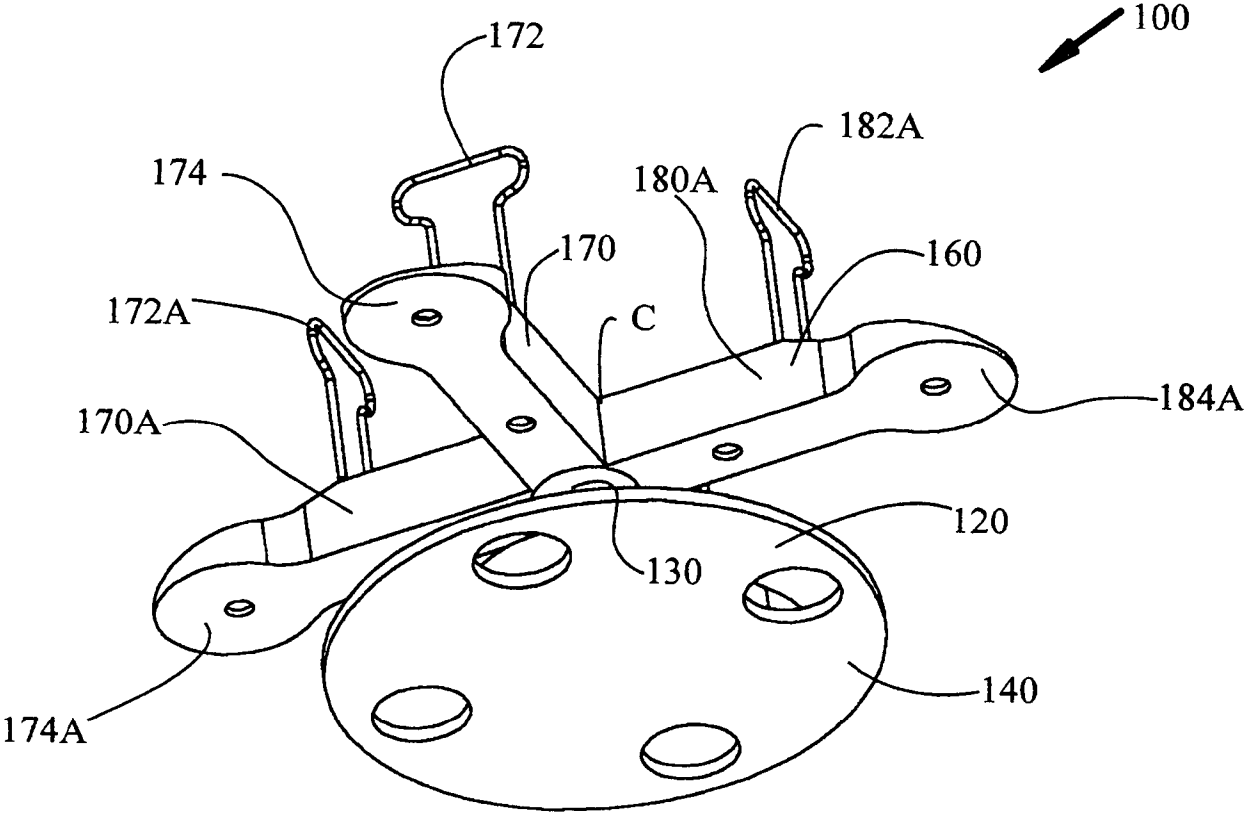
FIG. 6 is a bottom perspective view of the apparatus of FIGS. 4 and 5.
Figure 7:
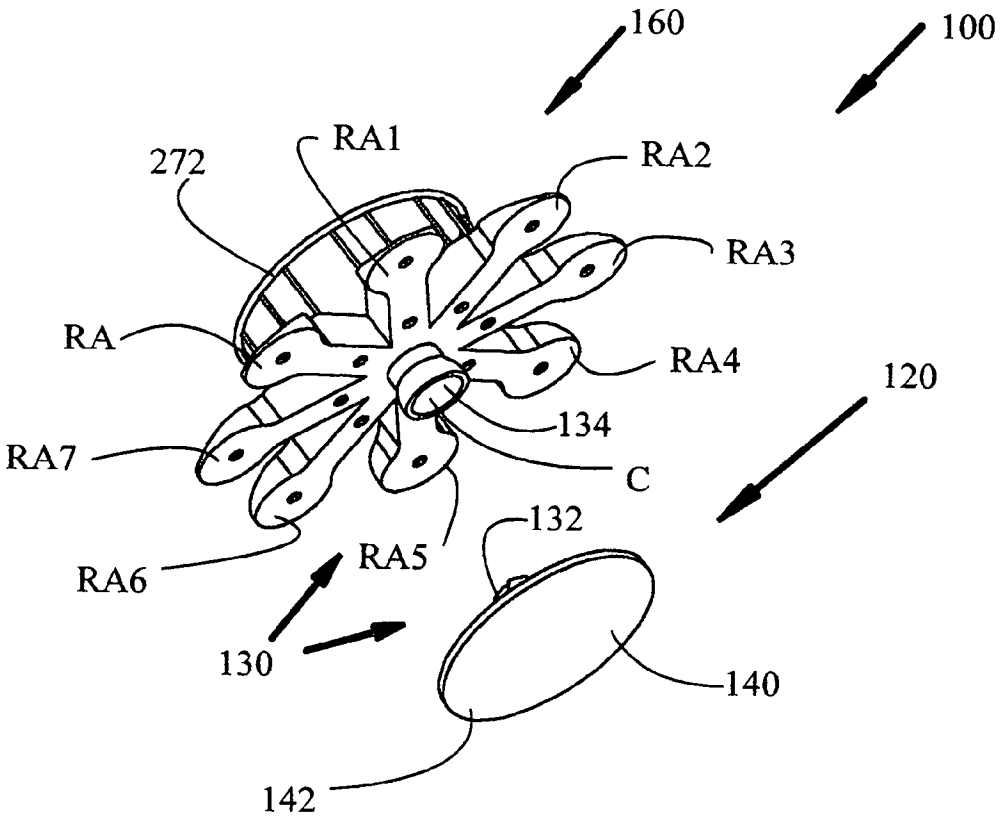
FIG. 7 is a bottom perspective view of the apparatus of the second embodiment including an intersecting platforms structure having eight jumping platforms and a fulcrum base including a disk-shaped platform.
Figure 8:
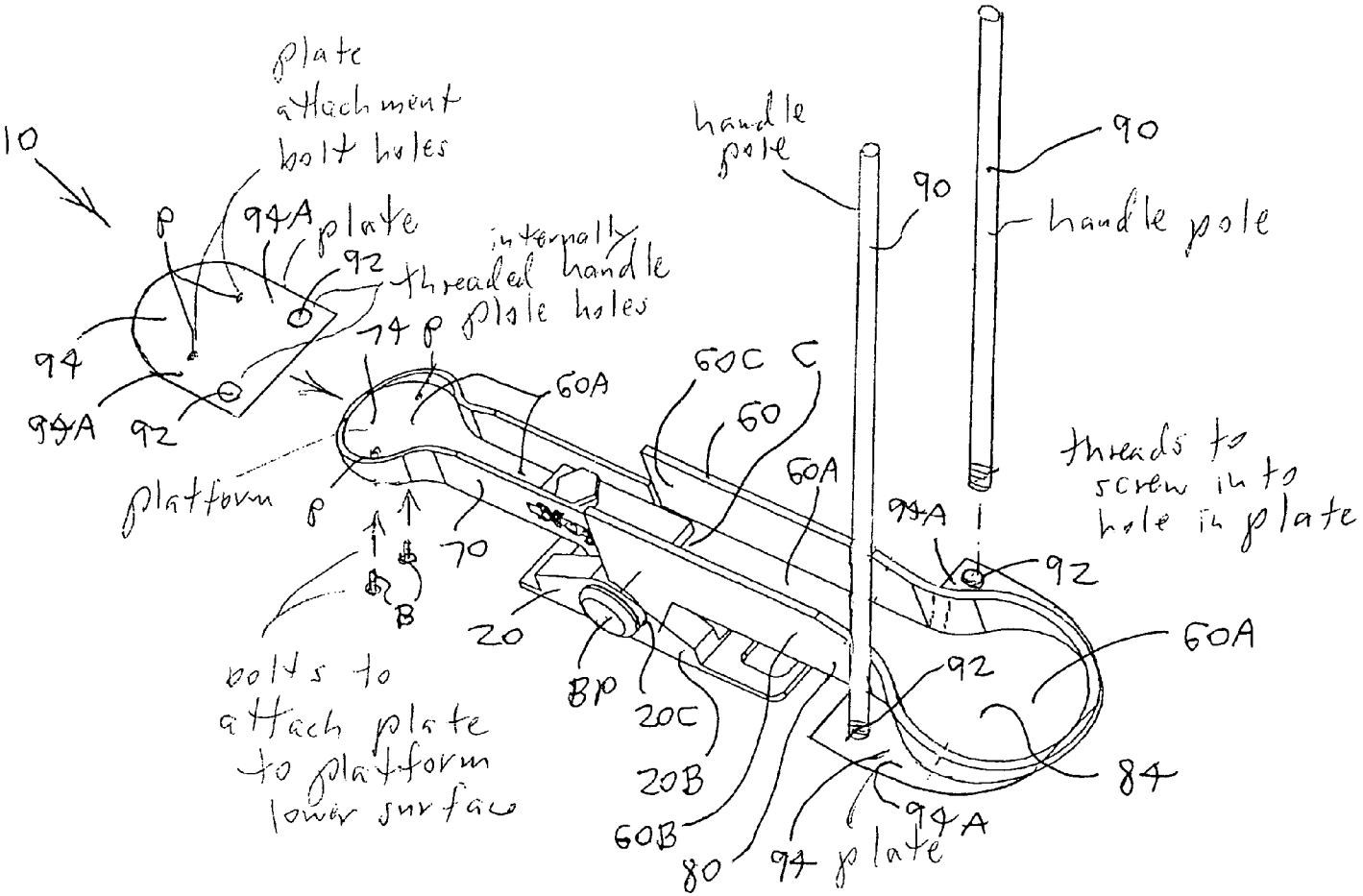
FIG. 8 is a perspective view of the apparatus of FIG. 3 having the upright gripping pole version of the user supports.

Referring generally to FIGS. 1-8, and more specifically to FIGS. 1-3, an opposed jumping platform apparatus 10 is disclosed including a fulcrum base 20 and an opposed platforms member 60 having an opposed platforms member center C pivotally mounted on the fulcrum base 20 and dividing the opposed platforms member 60 into a first jumping platform 70 and an opposing second jumping platform 80. The first jumping platform 70 having an upright first user support 72 secured to and extending upwardly from the first jumping platform 70 at least one and one half feet and preferably extending upwardly two, three or four feet, depending on the height of intended user, and the second jumping platform 80 having an upright second user support 82 secured to and once again extending upwardly from the second jumping platform 80 at least one and one half feet and preferably extending upwardly two, three or four feet. The first user support 72 and the second user support 82 preferably are spaced from the opposed platforms member center C. A first user stands upright on the first jumping platform 70 and grips the first user support 72 and a second user stands upright on the second jumping platform 80 and grips the second user support 82, and then one of the two users jumps and lands on his or her jumping platform 70 or 80, causing his or her jumping platform to pivot downwardly and the opposing jumping platform 80 or 70 consequently to pivot upwardly, whereupon the other user jumps and lands on his or her jumping platform 80 or 70, causing his or her jumping platform to pivot downwardly and the opposing jumping platform 70 or 80 to pivot upwardly. These steps are repeated as long as the users wish to continue.

The user supports 72 are structures for a user to grip to secure and steady himself or herself while jumping, such as on platform 70 or 80, and user supports 72 may take many forms. One preferred version is that shown in FIGS. 1-7, consisting of an elongate member such as a bar or pipe having a substantially inverted U-shape, so that the user can grip the horizontal cross-segment at the top. Another preferred version is that shown in FIG. 8, which takes the form of two laterally spaced apart upright gripping poles 90 secured relative to each jumping platform 70 or 80. These are preferred for adult users, although both preferred versions may be provided for either adults or children. While the gripping poles 90 may be secured to the platforms 70 or themselves, or to the opposed platforms member 60, it is preferred that poles 90 be screwed into internally threaded pole ports 92 in pole mounting plates 94. A pole mounting plate 94 is in turn secured to the bottom surface of each jumping platform 70 or 80 such as with bolts B entering respective threaded ports P, and each mounting plate 94 is wider than the corresponding platform 70 or 80, defining outward plate wing portions 94A. The threaded pole ports 92 are located in the opposing outwardly protruding plate wing portions 94A, so that the platforms 70 and 80 do not block insertion of a gripping pole 90 into its respective pole port 92. Each gripping pole 90 preferably protrudes above the adjacent platform 70 or 80 to a height substantially matching the height of a person standing on the platform 70 or 80, although many gripping pole 90 heights are contemplated.

The opposed platforms member 60 preferably is channel-shaped, having a channel connecting wall 60A and longitudinal channel side walls 60B and 60C, for added strength to absorb and withstand the impact of user jumping, the channel side walls 60B and 60C preferably extending upwardly from the connecting wall 60A. The jumping platforms 70 and 80 preferably each have a user jumping segment 74 or 84 at its respective member free end, and the channel side walls 60B and 60C preferably extend from the opposed platforms member center C and become shorter or terminate at the respective user jumping segment 74 or 84, so that the user jumping segments 74 and 84 have short channel side walls 60B and 60C for child users or no channel side walls 60B and 60C for adult users. The user jumping segments 74 and 84 preferably expand laterally to a width greater than the width of the rest of the opposed platforms member 60 to provide a broader user standing area, the expanded user jumping segments 74 and 84 preferably being substantially circular.

The fulcrum base 20 preferably is a channel-shaped member as well, having two spaced apart base side walls 20B and 20C and a connecting base bottom wall 20A, and extending parallel to and underneath the opposed platforms member 60. A base rocking pin BP passes through wall ports 20D and 20E in and extends between the two base side walls 20B and 20C, and the opposed platforms member 60 has downwardly protruding member rocking flanges 62 and 64 which are fitted between the base side walls 20B and 20C with rocking flange ports (not shown) through which the rocking pin BP passes, so that the rocking pin BP pivotally mounts the opposed platforms member 60 onto the fulcrum base 20.

A foldable version of apparatus 10 is provided which can be folded into a compact configuration for transport and storage and then redeployed into its unfolded configuration for use when and where desired. See FIG. 3. For the foldable version, the first jumping platform 70 is separate from and pivotally joined to the second jumping platform 80 by an platform folding pin AFP, which may be base pin BP, and second jumping platform 80 is narrower than the first jumping platform 70 to pivot on top of and fit within the channel side walls 20B and 20C of first jumping platform 70.

Second Preferred Embodiment

A four platform embodiment of apparatus 100 is also provided as shown in FIGS. 4-7 in which the platforms member is an intersecting platforms structure 160 having two integral intersecting platforms members defining first, second, third and fourth jumping platforms 170, 180, 170A and 180A, preferably perpendicular to each other defining an intersecting platforms structure center C. The intersecting platforms structure 160 connects to a fulcrum base 120 through a universal pivot mechanism 130, so that all four jumping platforms 170, 180, 170A and 180A can pivot up and down with the opposing jumping platform pivoting down or up, respectively. The fulcrum base 120 preferably is a platform 140 having stacked panels 142, 144 and 146 having upwardly progressively smaller diameters and the universal pivot mechanism 130 preferably includes a ball 132 secured to and protruding upwardly from the top of the platform 140 and a socket 134 protruding downwardly from the intersecting platforms structure center C. The second embodiment can be disassembled for transport and storage by lifting the socket 134 off the ball 132 so that the intersecting platforms structure 160 and fulcrum base 120 are separated, and then folding first, second, third, fourth user supports 172, 182, 172A and 182A adjacent to first, second, third and fourth jumping segments 174, 184, 174A and 184A down against the intersecting platforms structure 160. The intersecting platforms structure 160 optionally includes still additional jumping platforms such as the eight jumping platform RA, RA1, RA2, RA3, RA4, RA5, RA6 and RA7 version illustrated in FIG. 7, having a circular collective users support 272.

Method

In practicing the invention, the following method may be used. As noted above, the method of apparatus 10 use includes the steps of: a first user standing upright on the first jumping platform 70 and gripping the first user support 72 and a second user standing upright on the second jumping platform 80 and gripping the second user support 82, and then one of the two users jumping and landing on his or her jumping platform 70 or 80, causing his or her jumping platform to pivot downwardly and the opposing jumping platform 80 or 70 consequently to pivot upwardly, the other user jumping and landing on his or her jumping platform 80 or 70, causing his or her jumping platform to pivot downwardly and the opposing jumping platform 70 or 80 to pivot upwardly. These steps are repeated as long as the users wish to continue.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An opposed jumping platform apparatus, comprising:

a fulcrum base;

and an opposed platforms member having an opposed platforms member center pivotally mounted on the fulcrum base and dividing the opposed platforms member into a first jumping platform and an opposing second jumping platform, said first jumping platform having a first user support spaced from said opposed platforms member center extending at least one and one half feet above said first jumping platform, and said second jumping platform having a second user support spaced from said platform structure center extending at least one and one half feet above said second jumping platform;

wherein said first jumping platform is separate from and pivotally joined to said second jumping platform by a platform folding pivot structure;

such that said second jumping platform is pivotable at said folding pivot structure onto said first jumping platform.

2. The apparatus of claim 1, wherein said opposed platforms member is channel-shaped, having a channel connecting wall and channel side walls, for added strength to absorb and withstand the impact of human jumping and to be light in weight.

3. The apparatus of claim 2, wherein said platform folding pivot structure comprises a platform folding pin;

and said second jumping platform is narrower than said first jumping platform to fit within said channel side walls of said first jumping platform when pivoting on top of said first jumping platform.

4. The apparatus of claim 1, wherein said channel side walls extend upwardly from said channel connecting wall.

5. The apparatus of claim 4, wherein said jumping platforms each have a user jumping segment at its member free end.

6. The apparatus of claim 4, wherein said channel side walls extend from said opposed platforms member center and terminate at the respective said user jumping segment;

such that said user jumping segments have no channel side walls intended for adult users.

7. The apparatus of claim 1, wherein said user jumping segments expand laterally to a width greater than the width of the rest of said opposed platforms member to provide a broader user standing area.

8. The apparatus of claim 7, wherein the expanded user jumping segments are substantially circular.

9. The apparatus of claim 1, wherein said fulcrum base is a channel-shaped member, comprising two spaced apart base side walls and a base connecting wall, and extending parallel to and underneath said opposed platforms member.

10. The apparatus of claim 1, wherein said first user support comprises at least one upright gripping pole secured relative to each said jumping platform.

11. An opposed jumping platform apparatus, comprising:

a fulcrum base;

an opposed platforms member having an opposed platforms member center pivotally mounted on the fulcrum base and dividing the opposed platforms member into a first jumping platform and an opposing second jumping platform, said first jumping platform having a first user support spaced from said opposed platforms member center extending at least one and one half feet above said first jumping platform, and said second jumping platform having a second user support spaced from said platform structure center extending at least one and one half feet above said second jumping platform; and wherein said opposed platforms member is channel-shaped, having a channel connecting wall and channel side walls, for added strength to absorb and withstand the impact of human jumping and to be light in weight;

wherein said channel side walls extend upwardly from said channel connecting wall;

wherein said jumping platforms each have a user jumping segment at its member free end;

wherein said channel side walls extend from said opposed platforms member center and become shorter at the respective said user jumping segment;

such that said user jumping segments have short channel side walls intended for child users.

12. The apparatus of claim 11, wherein said user jumping segments expand laterally to a width greater than the width of the rest of said opposed platforms member to provide a broader user standing area.

13. An opposed jumping platform apparatus, comprising:

a fulcrum base;

an opposed platforms member having an opposed platforms member center pivotally mounted on the fulcrum base and dividing the opposed platforms member into a first jumping platform and an opposing second jumping platform, said first jumping platform having a first user support spaced from said opposed platforms member center extending at least one and one half feet above said first jumping platform, and said second jumping platform having a second user support spaced from said platform structure center extending at least one and one half feet above said second jumping platform; and wherein said opposed platforms member is channel-shaped, having a channel connecting wall and channel side walls, for added strength to absorb and withstand the impact of human jumping and to be light in weight; and wherein said fulcrum base is a channel-shaped member, comprising two spaced apart base side walls and a base connecting wall, and extending parallel to and underneath said opposed platforms member;

a base rocking pin passing through wall ports in and extending between said base side walls, said opposed platforms member having downwardly protruding member rocking flanges which are fitted between said base side walls and have rocking flange ports through which said rocking pin passes;

such that said rocking pin pivotally mounts said opposed platforms member on said fulcrum base.

14. An opposed jumping platform apparatus, comprising:

a fulcrum base;

and an opposed platforms member having an opposed platforms member center pivotally mounted on the fulcrum base and dividing the opposed platforms member into a first jumping platform and an opposing second jumping platform, said first jumping platform having a first user support spaced from said opposed platforms member center extending at least one and one half feet above said first jumping platform, and said second jumping platform having a second user support spaced from said platform structure center extending at least one and one half feet above said second jumping platform;

wherein said first user support comprises an elongate member having a substantially inverted U-shape having a substantially horizontal cross-segment and being secured to one of the platform and the opposed platforms member, such that it is intended that a user can grip said cross-segment.

15. An opposed jumping platform apparatus, comprising:

a fulcrum base;

and an opposed platforms member having an opposed platforms member center pivotally mounted on the fulcrum base and dividing the opposed platforms member into a first jumping platform and an opposing second jumping platform, said first jumping platform having a first user support spaced from said opposed platforms member center extending at least one and one half feet above said first jumping platform, and said second jumping platform having a second user support spaced from said platform structure center extending at least one and one half feet above said second jumping platform;

wherein said first user support comprises at least one upright gripping pole secured relative to each said jumping platform; and wherein each said at least one gripping pole is secured to one of: a corresponding jumping platform, the opposed platforms member and a pole mounting plate secured to said corresponding jumping platform, where each said mounting plate is wider than the corresponding said jumping platform, defining outward plate wing portions each having an internally threaded pole port into which one said gripping pole is fitted and secured.

16. An opposed jumping platform apparatus, comprising:

a fulcrum base;

and an intersecting platforms structure having an opposed platforms member center pivotally mounted on the fulcrum base through a rocking mechanism and dividing the opposed platforms member into a plurality of jumping platforms, each said jumping platform having a user support spaced from said intersecting platforms structure center and extending at least one and one half feet above said first jumping platform;

wherein said rocking mechanism connects to a fulcrum base through a universal pivot structure, so that all of said jumping platforms can pivot up and down with the opposing said jumping platform pivoting down or up, respectively;

wherein said fulcrum base is a platform comprising stacked and interconnected disks having upwardly progressively smaller diameters.

17. The apparatus of claim 16, wherein said universal pivot mechanism comprises a ball secured to and protruding upwardly from the top of said fulcrum base and a socket protruding downwardly from said intersecting platforms structure into which said ball pivotally fits.

18. An opposed jumping platform apparatus, comprising:

a fulcrum base;

and an intersecting platforms structure having an opposed platforms member center pivotally mounted on the fulcrum base through a rocking mechanism and dividing the opposed platforms member into a plurality of jumping platforms, each said jumping platform having a user support spaced from said intersecting platforms structure center and extending at least one and one half feet above said first jumping platform;

wherein said rocking mechanism connects to a fulcrum base through, a universal pivot structure, so that all of said jumping platforms can pivot up and down with the opposing said jumping platform pivoting down or up, respectively; and wherein each said jumping platform comprises a user jumping segment which is wider than the width of the rest of the given said opposed platforms member to provide a broader user standing area.

19. A method of using an opposed jumping platform apparatus comprising a fulcrum base; and an opposed platforms member having an opposed platforms member center pivotally mounted on the fulcrum base and dividing the opposed platforms member into a first jumping platform and an opposing second jumping platform, the first jumping platform having a first user support spaced from the opposed platforms member center extending at least one and one half feet above said first jumping platform, and the second jumping platform having a second user support spaced from the opposed platforms member center extending at least one and one half feet above said second jumping platform; comprising the steps of:

a first user standing on the first jumping platform and gripping the first user support;

a second user standing on the second jumping platform and gripping the second user support;

the first user jumping and landing on the first jumping platform, causing the first jumping platform to pivot downwardly and the opposing second jumping platform to pivot upwardly;

and the second user jumping and landing on the second jumping platform, causing the second jumping platform to pivot downwardly and the opposing first jumping platform to pivot upwardly.

* * * * *